United States Patent [19]

Shader

[11] Patent Number: 4,685,217

[45] Date of Patent: Aug. 11, 1987

[54] ARCHERY

[76] Inventor: John M. Shader, 2008 SW. Pattulo Way, West Linn, Oreg. 97068

[21] Appl. No.: 780,992

[22] Filed: Sep. 27, 1985

[51] Int. Cl.[4] ..... F41G 1/46

[52] U.S. Cl. ..... 33/267

[58] Field of Search ..... 33/267; 124/87, 88

[56] References Cited

U.S. PATENT DOCUMENTS

| | | | |
|---|---|---|---|
| 2,991,556 | 7/1961 | Wilchek | 33/265 |
| 3,058,221 | 10/1962 | McNeel | 33/265 |
| 4,136,462 | 1/1979 | Topel | 33/265 |
| 4,494,313 | 1/1985 | Scott | 33/265 |
| 4,542,591 | 9/1985 | Montgomery | 33/265 |

*Primary Examiner*—Harry N. Haroian

[57] ABSTRACT

To attain accuracy in the sport of archery, reference points are used. These reference points are constant and do not vary. The Inline sight gives the archer an added point of reference that increases accuracy in the horizontal dimension. This invention is unique in that the archer can be any distance from the target and always have an added reference point. The Inline sight uses a vertical line positioned between the archer's eye and the standard pin sight that is attached to the front of the bow to attain this added reference point.

1 Claim, 3 Drawing Figures

ARCHERY

BACKGROUND OF THE INVENTION

Accuracy in the field of archery is based on fixed reference points. Reference points are fixed points the archer uses to direct the arrow at the intended target. The majority of archers presently use three reference points; 1. the archer's eye, 2. the standard pin type sight found on the front of the bow and shown in the drawing supplied as FIG. 1 and 3. the intended target. These three points allow the archer moderate accuracy. The problem with this system is the fact that the bow can be slightly twisted in the archer's hand yet all three points will line up. When this does occur the arrow will miss the intended target. This invention adds a fourth point of reference that increases accuracy. This fourth point of reference is in a position between the archer's eye and the standard pin sight on the front of the bow (shown in FIG. 1.) and far enough from the archer's eye so as not to cause eye strain. There are other sights sold that allow the archer this fourth point of reference. The Inline sight is unique because it uses a vertical line for the fourth reference point and allows the archer the ability to add just an extra reference point without purchasing an entire sighting system. The archer can now be any distance from the target yet still always have the fourth point of reference. The other sights that offer the fourth reference point are designed to be used at set distances. This may be adequate for target shooting but virtually useless in a hunting situation where distances are constantly changing. The Inline sight can be used at any variable distance. The objectives of this sight are as follows;

Objective 1. To allow the archer a fourth fixed point of reference that is always functional no matter what the distance is between the archer and the target.

Objective 2. To allow the archer a fourth fixed point of reference that does not impair the archer's field of vision.

Objective 3. To allow the archer a fourth fixed point of reference that can be used in dim lighting situations, for instance dusk or dawn.

Objective 4. To save the archer money by making it possible to add a fourth reference point to a bow without replacing the already existing front sight.

DETAILED DESCRIPTION

Figure 1:
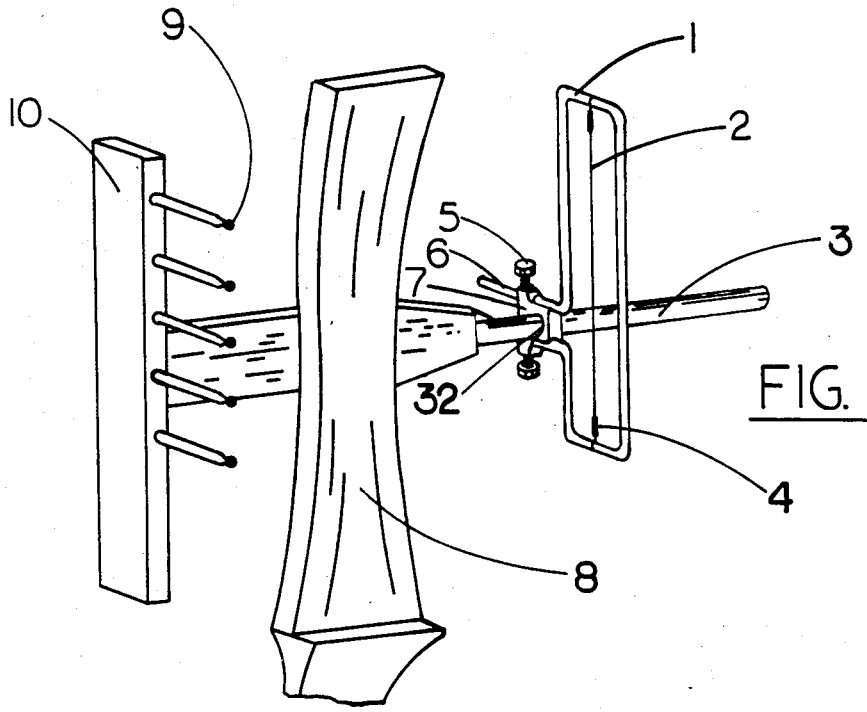
FIG. 1. This drawing is simply to give the examiners an idea of how the sight is situated on the bow. This picture also shows the pin type sight on the front of the bow.
Figure 2:
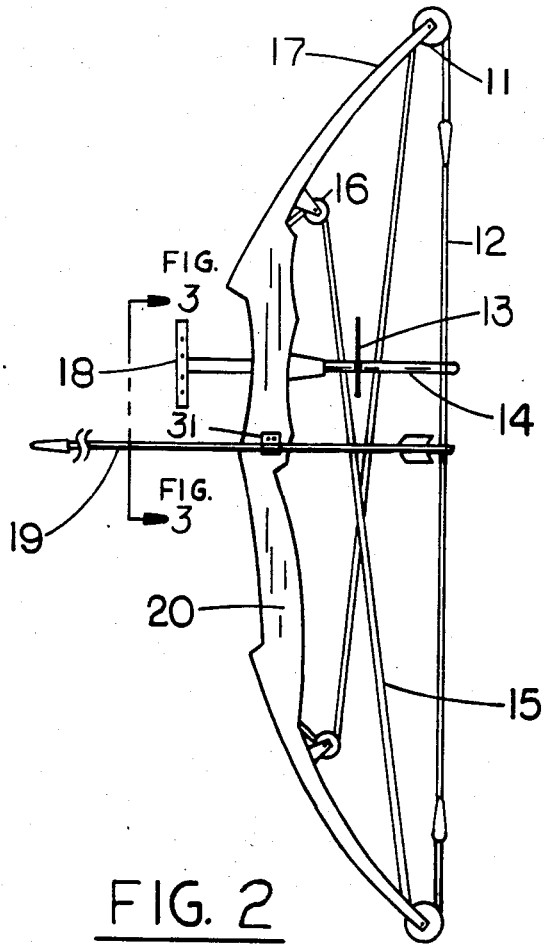
FIG. 2. a side view of the bow and inline sight.
Figure 3:
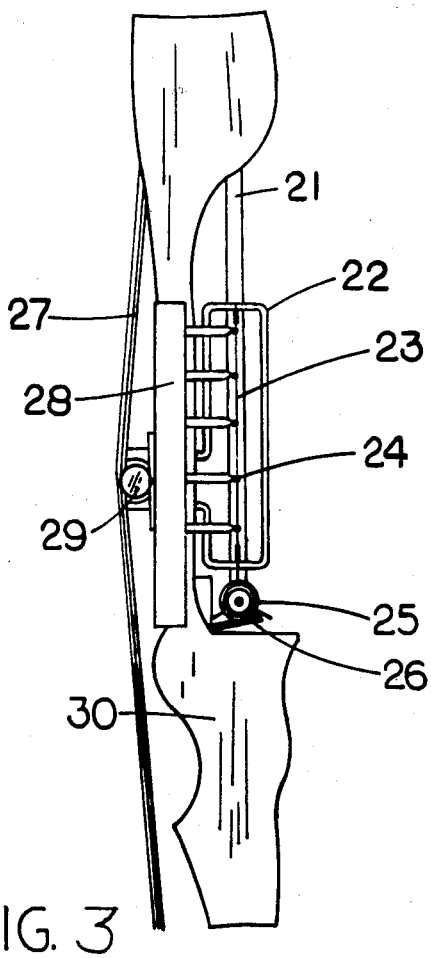
FIG. 3. a front view of the bow and inline sight.

Referring now more particularly to the drawings, the item in FIG. 2 is made from 13 ga. 304 stainless wire bent to the specifications shown in FIG. 2. The wire is then furnished with a black oxide to decrease glare. Seventeen lb. monofilament fish line is tied and glued as shown in FIG. 2. The glue may be any type so long as it is not water-soluable. The glue is so placed as to stop the knot from coming undone and also to hold the monofilament line in a stationary. position. The block shown in FIGS. 3 and 4 is constructed from a block, $1'' \times \frac{3}{4}'' \times \frac{1}{4}''$, of T-6 aluminum. It is then cut, drilled and tapped to the specifications shown in FIG. 4. The block is then finished with a black anodizing to reduce glare. The sight block in FIGS. 3 and 4 slides onto a 5/16" cable bar as shown in FIG. 1. The block is slid as far forward as possible so that the archer may easily focus on it. It is then locked into position using the 8-32 NC set screw shown in FIG. 3. The Inline sight window is moved left or right to a position where the monofilament line is in line with the archer's eye, the standard pin sight on the front of the bow and the intended target. The wire window is locked into place with the 6-32 NC cap screws shown in FIG. 3. The archer will now have four points of reference for sighting at a target; 1. the archer's eye, 2. the Inline sight, 3. the pin sight on the front of the bow, 4. the intended target.

The oblique drawing of FIG. 1 shows the Inline sighting line 2 attached to most superior and inferior portions of the sighting window 1 using a knot and glue 4 for method of attachment. Mounting block 7 is shown attached to the cable guard bar 3 by a set screw in the back of the mounting block (not shown). The open side of the sighting window 1 is designed to be slid into holes through mounting block 7 then secured into place in mounting block 7 by cap screws 5. A portion of the sighting window 1 is shown protruding through the back side of mounting block 7 at 6. The hole 32 through mounting block 7 is a diameter slightly larger than diameter of cable guard bar 3 to allow installation onto cable guide bar 3. The bow's riser 8, front sight 10 are also seen in this FIG. 1. Sighting pins 9 are shown in alignment with sighting line 2.

FIG. 2 shows pulleys 11, 16, bow string 12, Inline sight 13 attached to cable guard bar 14, cables 15, bow limbs 17, front pin sight 18, arrow 19, bow riser 20 and arrow rest.

FIG. 3 shows bow string 21; Inline sighting window 22, Inline sighting line 23 in alignment with pins 24 of front sight 28. Also shown in this FIG. 3; arrow 25 on arrow rest 26, bow riser 30, cables 27 riding over cable guard bar 29.

I claim:

1. An archery sight for use with a bow having a cable guard bar and front sight reference points arranged in vertical array, said sight comprising a mounting block and a sighting window, said sighting window comprising a rectangular open frame formed from a single length of relatively thin diameter wire, the free ends of said frame extending in spaced parallel relation to each other, the sides and free ends of said frame being coplanar, a thin sighting line is mounted to the short sides of the open frame and extends vertically parallel and coplanar with the long sides of the frame; said mounting block having a mounting hole therethrough for adjustably mounting the block on said cable guard bar and means on said block for locking said block on said bar in various positions of adjustment; said block also having a pair of spaced apertures extending therethrough in a direction perpendicular to said hole with one aperture of said pair above and the other below the mounting hole, the free ends of said sighting window being adjustably fixed in said apertures by cap screws provided on said block, said sight and its mounting allowing substantially unobstructed alignment of said thin sighting line with the intended target and with the bows front sight reference points.

* * * * *